US012281561B2

(12) United States Patent
Talya et al.

(10) Patent No.: US 12,281,561 B2
(45) Date of Patent: Apr. 22, 2025

(54) DETECTION, CLASSIFICATION AND MITIGATION OF LATERAL VIBRATIONS ALONG DOWNHOLE DRILLING ASSEMBLIES

(71) Applicant: Halliburton Energy Services, Inc., Houston, TX (US)

(72) Inventors: Shashishekara S. Talya, Humble, TX (US); Inho Kim, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 82 days.

(21) Appl. No.: 17/822,516

(22) Filed: Aug. 26, 2022

(65) Prior Publication Data

US 2024/0068349 A1 Feb. 29, 2024

(51) Int. Cl.

| | |
|---|---|
| ***E21B 44/00*** | (2006.01) |
| ***E21B 7/00*** | (2006.01) |
| ***E21B 47/12*** | (2012.01) |

(52) U.S. Cl.

CPC ..... *E21B 44/00* (2013.01); *E21B 47/12* (2013.01); *E21B 7/00* (2013.01); *E21B 2200/20* (2020.05)

(58) Field of Classification Search

CPC ..... E21B 7/00; E21B 44/00

See application file for complete search history.

(56) References Cited

U.S. PATENT DOCUMENTS

| | | | | |
|---|---|---|---|---|
| 2013/0248247 | A1* | 9/2013 | Sugiura | E21B 47/12 702/9 |
| 2015/0101865 | A1* | 4/2015 | Mauldin | E21B 44/00 175/40 |
| 2016/0115778 | A1 | 4/2016 | van Oort et al. | |
| 2017/0268324 | A1 | 9/2017 | Moore | |
| 2019/0169979 | A1 | 6/2019 | Nguyen et al. | |
| 2023/0313678 | A1* | 10/2023 | Saihati | E21B 45/00 175/50 |

FOREIGN PATENT DOCUMENTS

EP 2462315 B1 11/2018

* cited by examiner

*Primary Examiner* — Robert E Fuller
*Assistant Examiner* — Lamia Quaim
(74) *Attorney, Agent, or Firm* — Benjamin Ford; Parker Justiss, P.C.

(57) ABSTRACT

A drilling assembly control system is designed to mitigate drilling vibration by detecting and classifying lateral vibrations. Vibrations are detected along a bottom hole assembly using one or more inertial measurement units, those vibration measurements are classified by lateral vibration type, and mitigating actions are determined.

15 Claims, 8 Drawing Sheets

DETECTION, CLASSIFICATION AND MITIGATION OF LATERAL VIBRATIONS ALONG DOWNHOLE DRILLING ASSEMBLIES

FIELD OF THE DISCLOSURE

The present disclosure relates generally to drilling in hydrocarbon reservoirs or geothermal applications and, more specifically, to a drilling assembly system designed to detect, classify and mitigate vibrations along a bottom hole assembly of a drill string.

BACKGROUND

Hydrocarbon fossil fuels are a limited resource because of their associated cost of production. As easily accessible resources are used, new technology is necessary to minimize the cost of production and increase accessibility. One of the main drivers for the shale boom in North American is directional drilling. Using this technology to drill long horizontal wells that can be hydraulically fractured has made new resources available and driven the price of natural gas down throughout the past five years.

In simple terms, directional drilling is the practice of drilling a wellbore using a system that provides control of the drill bit orientation or applied side forces at the bit. This system allows drilling along a controlled path in almost any direction. Beyond drilling long horizontal boreholes, directional drilling can also create multiple wells using one rig, extending unreachable locations, relieving blowing wells with reduced loss, and avoiding hard-to-drill formations. To enable control of the bit, the bottom hole assembly ("BHA") is equipped with a mechanism to either apply force to the wall of the borehole or change the direction in which the bit is pointing in relationship to the BHA. These systems are known as either "push-the-bit," or "point-the-bit," depending on how the mechanism operates.

Such systems, as well as traditional drilling systems, often experience vibrations which can detrimentally affect drilling operations. Lateral vibrations during both on-bottom and off-bottom rotations can cause destructive dynamical behaviors in the BHA. Single sizable lateral vibration events combined with normal drill string rotations can destroy any location of the BHA within a fraction of seconds, and especially modern BHAs are more likely prone due to their multifunctional components such as directional drilling structures and complex sensing and control electronics. Unlike drill string torsional vibrations which can propagate along drill pipes to surface measurement equipment (and be compensated for), lateral vibrations do not propagate long distances to the surface. Thus, the industry relies on data from a single downhole inertial measurement unit (IMU) to measure lateral vibration.

Conventional methods to classify vibration are primarily based on the severity of the vibration and don't take into consideration the type of lateral vibration (e.g., forward whirl, backward whirl, chaotic vibration, etc.—all types of lateral vibration. In addition, the limited telemetry bandwidth constrains the amount of vibration related information that can be pulsed to the surface. As a result, the driller on the surface has very limited knowledge of the exact dynamic state of the BHA downhole. Therefore, the recommended action to mitigate vibration is qualitative in nature which can result in a very conservative action, resulting in poor drilling performance (e.g., Rate of Penetration ("ROP") or steering performance) or can result in action causing downhole tool failure.

DESCRIPTION OF ILLUSTRATIVE EMBODIMENTS

Figure 1:
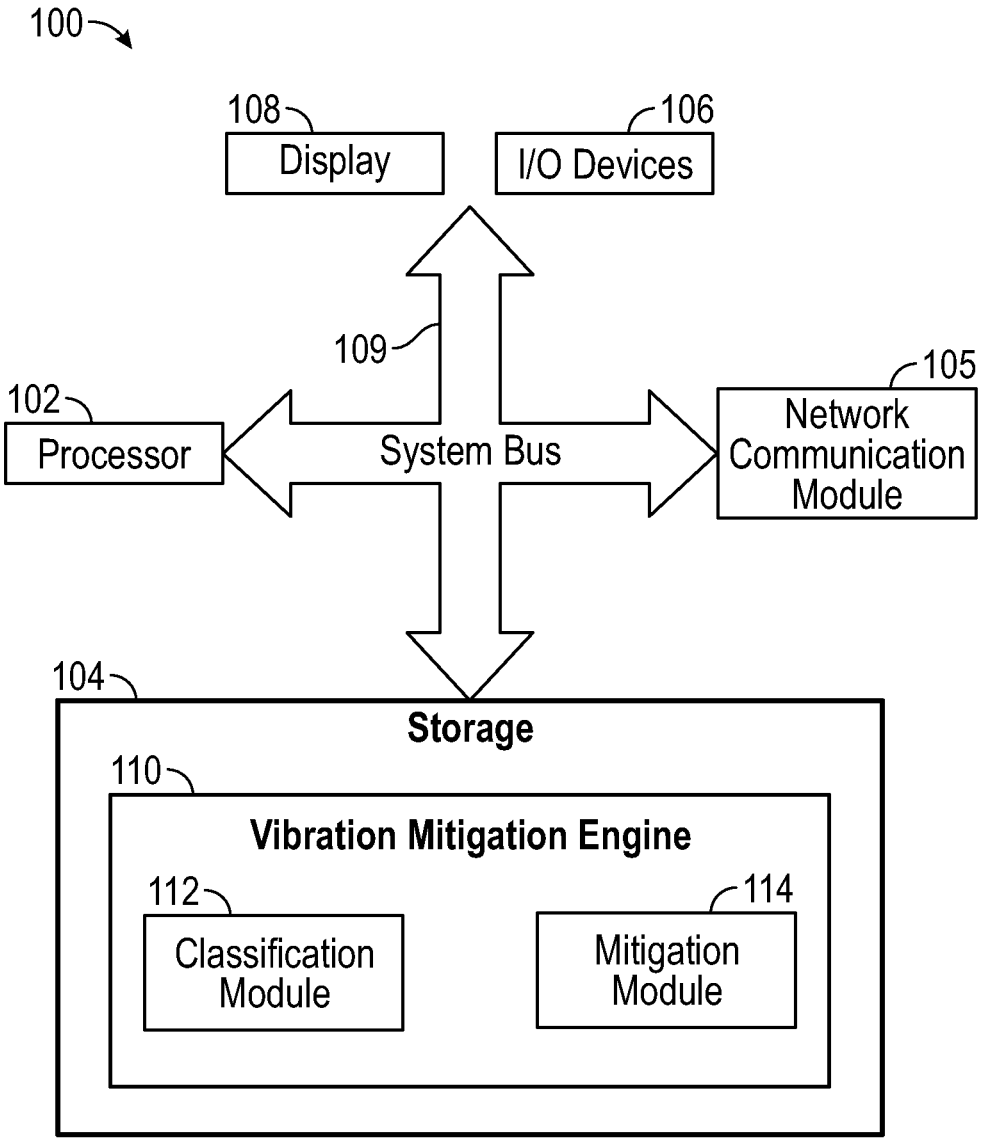
FIG. 1 illustrates a block diagram of a vibration mitigation system according to an illustrative embodiment of the present disclosure.

Illustrative embodiments and related methodologies of the present disclosure are described below as they might be employed in a drilling system to detect, classify and mitigate vibration along drilling assemblies. In the interest of clarity, not all features of an actual implementation or methodology are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methodologies of the disclosure will become apparent from consideration of the following description and drawings.

Exemplary embodiments of the present invention are directed to systems and methods to mitigate vibration along drilling assemblies. In a generalized method, a drilling assembly is deployed down hole along a hydrocarbon bearing wellbore. The drilling assembly includes a BHA having a drilling system and one or more inertial measurement units ("IMUs") positioned along the BHA. The IMUs obtain vibration measurements of the BHA. Processing circuitry coupled to the IMUs then process the vibration measurements in order to classify the vibration type. The classification may involve determining whether the vibrations are lateral vibrations such as, for example, forward whirl, backward whirl or chaotic vibration. Once the vibration has been classified by the processing circuitry, the system then determines an action suitable to mitigate the vibration.

Illustrative embodiments of the present disclosure provide systems to monitor, detect and classify vibration in real-time. Operators can then be notified in real-time while drilling during on-bottom and off-bottom situations using the distributed IMUs and interpretations of the IMU data in the BHA. Due to the limited telemetry bandwidth, the calculations/logic for vibration classification can be executed downhole and a vibration state will be pulsed to the surface for the driller to take action. In some embodiments, the action can be automated to automatically adjust drilling parameter set-points (e.g., WOB, RPM, flow rate). In instances where the telemetry bandwidth is not a limitation (e.g. wired pipe), the classification logic can be executed on the surface.

To determine the vibration classification in real-time, a probabilistic or heuristic approach will be used to identify the probability that a particular type of vibration is occurring during drilling. In certain illustrative embodiments, this involves processing data from multiple IMUs, performing different types of data analysis (e.g., fast Fourier transform), executing tunable models that describe the dynamic state of the system and statistical analysis to classify vibration. Results from data processing of each IMU and model will be assigned a probability number based on the IMU location, type, uncertainty of data and model confidence. By summing up the probability from the different sources, the system derives the overall probability of occurrence of a particular type of vibration which is ultimately used to determine suitable mitigation operations.

FIG. 1 shows a block diagram of BHA vibration mitigation system 100 according to an illustrative embodiment of the present disclosure. As will be described herein, illustrative embodiments of BHA vibration mitigation system 100 provides a control system to detect, classify and mitigate the effects of vibrations on the drilling system orientation. BHA vibration mitigation system 100 includes at least one processor 102, a non-transitory, computer-readable storage 104, transceiver/network communication module 105, optional I/O devices 106, and an optional display 108 (e.g., user interface), all interconnected via a system bus 109. Software instructions executable is by the processor 102 for implementing software instructions stored within vibration mitigation engine 110 in accordance with the illustrative embodiments described herein, may be stored in storage 104 or some other computer-readable medium.

Although not explicitly shown in FIG. 1, it will be recognized that BHA vibration mitigation system 100 may be connected to one or more public and/or private networks via one or more appropriate network connections. It will also be recognized that the software instructions comprising vibration mitigation engine 110 may also be loaded into storage 104 from a CD-ROM or other appropriate storage media via wired or wireless methods.

Moreover, those skilled in the art will appreciate that the disclosure may be practiced with a variety of computer-system configurations, including hand-held devices, multiprocessor systems, microprocessor-based or programmable-consumer electronics, minicomputers, mainframe computers, and the like. Any number of computer-systems and computer networks are acceptable for use with the present disclosure. The disclosure may be practiced in distributed-computing environments where tasks are performed by remote-processing devices that are linked through a communications network. In a distributed-computing environment, program modules may be located in both local and remote computer-storage media including memory storage devices. The present disclosure may therefore, be implemented in connection with various hardware, software or a combination thereof in a computer system or other processing system.

In certain illustrative embodiments, vibration mitigation engine 110 comprises classification module 112 and mitigation module 114. Classification module 112 is utilized to perform heuristic or probabilistic calculations to classify the vibrations based on multiple data/model sources. Further, classification module 112 performs the frequency analysis, modeling, and compression processes described herein. Vibration mitigation engine 110 also performs the necessary geological interpretation and earth modeling functions of the present disclosure that enable, for example, formation visualization and real-time geosteering, geothermal or other suitable applications. To achieve this, as will be described in further detail below, vibration mitigation engine 110 uploads real-time vibrational data detected by the IMUs, performs various interpretational and forward modeling operations on the data, and utilizes display 108 to provide desired visualizations of a corresponding well path. In addition, vibration mitigation engine 110 may also detect faults, estimate the location of the bit relative to the intended drill path, and predict downhole vibrations.

Still referring to FIG. 1, mitigation module 114 analyzes the classification data in order to determine a suitable mitigation action. For example, in geo-steering applications, the mitigation action may be to change drilling parameters such as weight on bit or rotational speed (RPM). In other examples, the mitigation action may involve adjusting some other drilling parameter such as, for example, changing RPM. In some instances, if the vibration is very severe, it might require picking off-bottom to dissipate the energy in the system and then go on-bottom to drill using different drilling parameters.

Although not shown, vibration mitigation engine 110 may also control the steering functions of the drilling assembly. In certain embodiments, once the mitigation action has been determined, mitigation module 114 determines the corresponding drilling parameters and transmits them a steering module which then communicates the drilling parameters to the drilling assembly to steer it accordingly.

Moreover, in certain other illustrative embodiments, vibration mitigation engine 110 may be in communication with various other modules and/or databases. For example, such databases may provide robust data retrieval and integration of historical and real-time well related data that spans across all aspects of the well construction and completion processes such as, for example, drilling, cementing, wireline logging, well testing and stimulation. Moreover, such data may include, for example, well trajectories, log data, surface data, fault data, etc. In such embodiments, vibration mitigation engine 110 may also provide, for example, the ability to select data for a multi-well project, edit existing data and/or create new data as necessary to interpret and implement a 2D or 3D well visualization of various well paths.

Illustrative Drilling Assembly Configuration:

Borehole trajectory is mainly controlled by the direction of the bit, which is steered by the drilling assembly. There are two main methods to direct the bit using the drilling assembly: push-the-bit and point-the-bit. While the former system applies a side force against the borehole wall to force the bit in the desired direction, the latter applies rotary torque on the driveshaft to bend the drilling assembly and tilt the bit. The description provided herein, however, focuses on drilling assemblies that employ point-the-bit type steering. However, those ordinarily skilled in the art having the benefit of this disclosure will understand that the present disclosure can also be applied with push the bit type steering.

Figure 2:
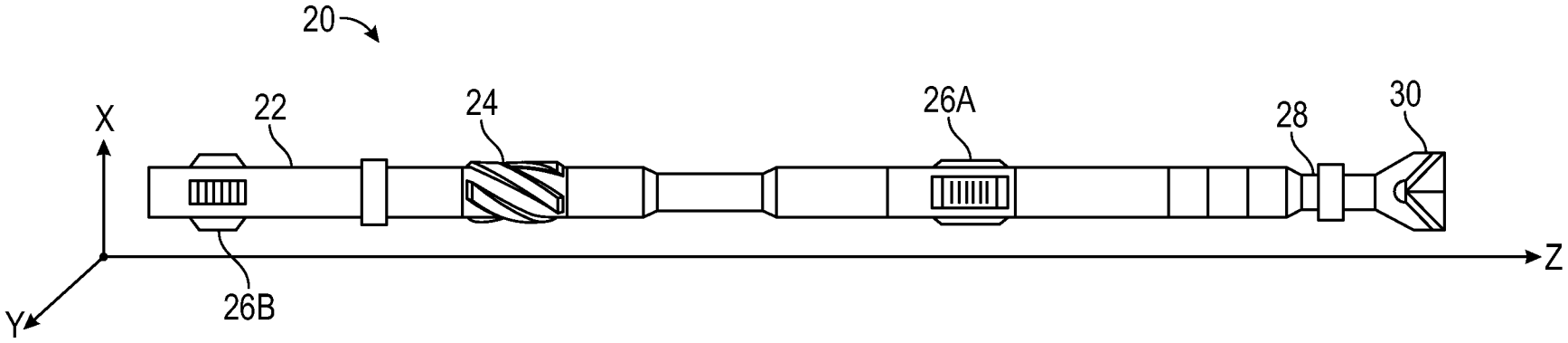
FIG. 2 illustrates a drilling assembly according to certain illustrative embodiments of the present disclosure.

To further illustrate the present disclosure, an illustrative BHA of a drilling assembly is illustrated in FIG. 2. Drilling assembly/BHA 20 consists of a drill collar 22, stabilizers 24, sensor packages 26A and 26B, a bending shaft 28, and a bit 30. In this example, sensor packages 26A and 26B include multiple IMUs (which include the necessary accelerometers, etc to detect vibrations). In other illustrative embodiments, more or less IMUs may be positioned along the BHA illustrated in FIG. 2. The main purpose of stabilizers 24 is to stabilize drilling assembly 20 within the borehole, reducing vibrations, restricting lateral movements, and providing support forces. Stabilizers 24 also serve as steersman of bit 30, when employing the push-the-bit mechanism. A point-the-bit steering mechanism is utilized to flex bending shaft 28 using a pair of eccentric rings controlled by a gear and clutch system. By controlling the amount of bending of shaft 28, bit 30 can be pointed in the desired direction. Sensor packages 26A and 26B may also include strain gauges, pressure measurements, and an inertial sensing package.

Now the fundamentals underlying the present disclosure will be discussed. During the pre-job design stage, structural analysis and simulations may be conducted by vibration mitigation system 100 with the BHA design with expected operating drilling parameters, such as RPM and WOB and well plan scenarios such as inclinations and doglegs. The goal is to identify optimal locations to place the IMUs 26 along the BHA. Because of highly dynamic drilling environments in the downhole environment, boundary conditions such as formation, contact points in the BHA, cuttings and mud, etc. change continuously. So, in certain illustrative embodiments, the pre-job analysis of vibration mitigation system 100 may include performing transient dynamics analysis or a natural frequency analysis to understand the mode shapes and frequencies for different BHA states or a forced response/harmonic analysis to understand vibration tendencies of the BHA. In this illustrative embodiment, based on simulation results, vibration mitigation system 100 determines IMU placement locations to effectively measure the dynamic event. This will enable systems of the present disclosure to provide efficient data analysis, such as frequency analysis of sensory data to clearly capture high lateral vibration, resonant frequencies and modal displacements of lateral vibration dynamics at each IMU location. In the case when sensor placement at a particular location is not possible, simulation results at known IMU locations can be used to collect the frequency analysis results of expected sensory data.

Due to highly dynamic downhole drilling conditions, time-variant dynamic vibration signatures cannot be easily classified based on single or multiple direct kinematic or dynamic sensory measurements obtained from IMUs. Each sensory result has its own specific information embedded in data, and cannot be directly used to represent the dynamic state of the entire BHA (which is typically hundreds of feet long). Hence, in the illustrative methods described herein, multiple physics-based data extraction methods are employed to derive probabilistic evidences which connect between conditional probability of target vibration class and prior vibration knowledge. The likelihood probability functions for individual conditional probability are derived based on historical drilling data and existing drilling operational guidelines. In certain embodiments, the system updates the likelihood probability functions by collecting vibration events during every drilling activity. Then, the Bayes probability model for vibration classification can be derived as:

$$p(\text{Class}_k|x) = \frac{p(\text{Class}_k)p(x|\text{Class}_k)}{p(x)}, \quad \text{Eq. 1}$$

where $p(\text{Class}_k)$ is the prior vibration knowledge, $p(x\backslash\text{Class}_k)$ is the likelihood probability function, $p(x)$ is the extracted sensory data, and $p(\text{Class}_k\backslash x)$ is the vibration classification result based on measured data. The likelihood probability $p(x\backslash\text{Class}_k)$ is the key input for the robust vibration classification probability model. In certain embodiments, multiple conditionally mutually exclusive evidence can be encoded in the probability functions for the lateral vibration classification.

Systems of the present disclosure can be used simulate wellbore conditions in order to determine the most optimal placement of IMUs along the BHA. Based on simulation results at expected locations of IMUs, the system can determine various levels of acceleration measurement thresholds both in tangential and radial directions. Each level of threshold contains physical limitations of BHA dynamics based on given operation parameters such as, for example, RPM, WOB and dogleg, and the conditional probabilities correlation to physics-based dynamics can be formed by the system. The joint probability between the physics-based conditional probabilities can then reduce the probability of the uncorrelated and outlier sensor readings from the real measurements. The final joint probability is one of the conditional probabilities of likelihood input to the classification probability model.

Figure 3:
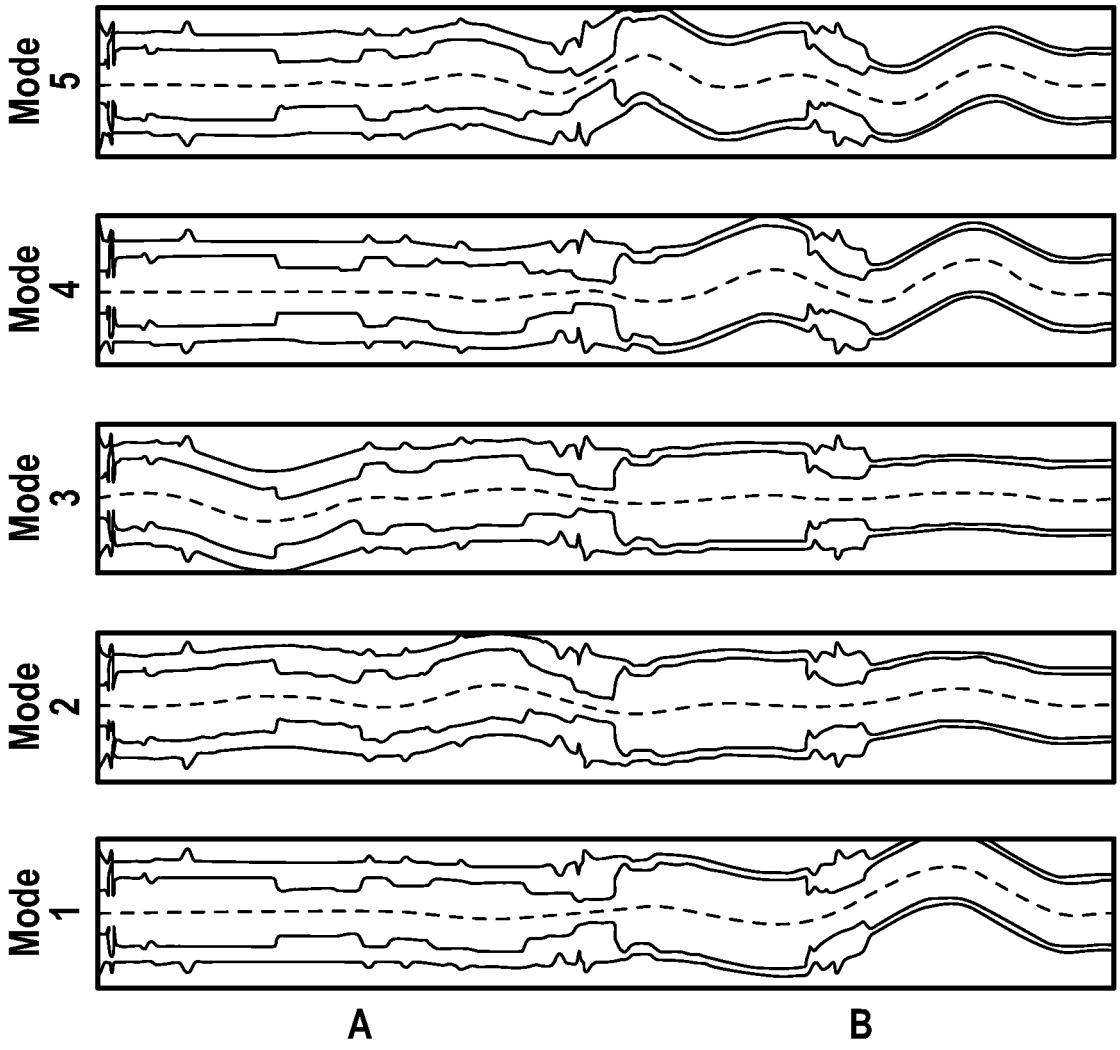
FIG. 3 illustrates five graphs showing the first five frequency and different mode shapes
Figure 4A:
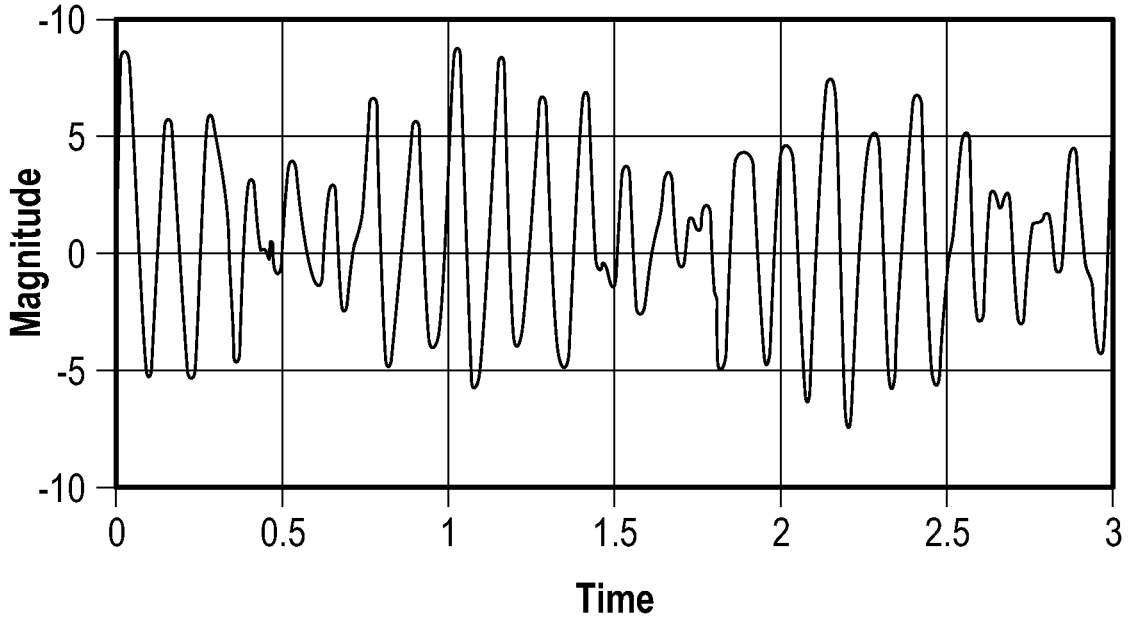
FIGS. 4A-4D show four graphs which illustrate the time history signals measured at IMUs, along with Fast Fourier transform (frequency) results at those IMUs.
Figure 4B:
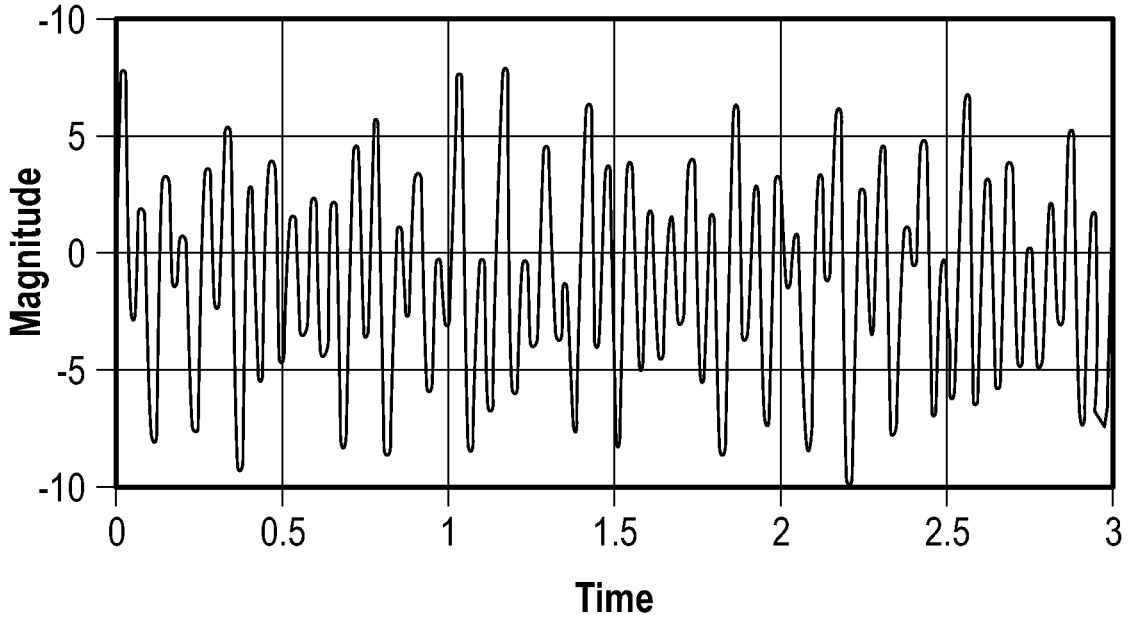
Figure 4C:
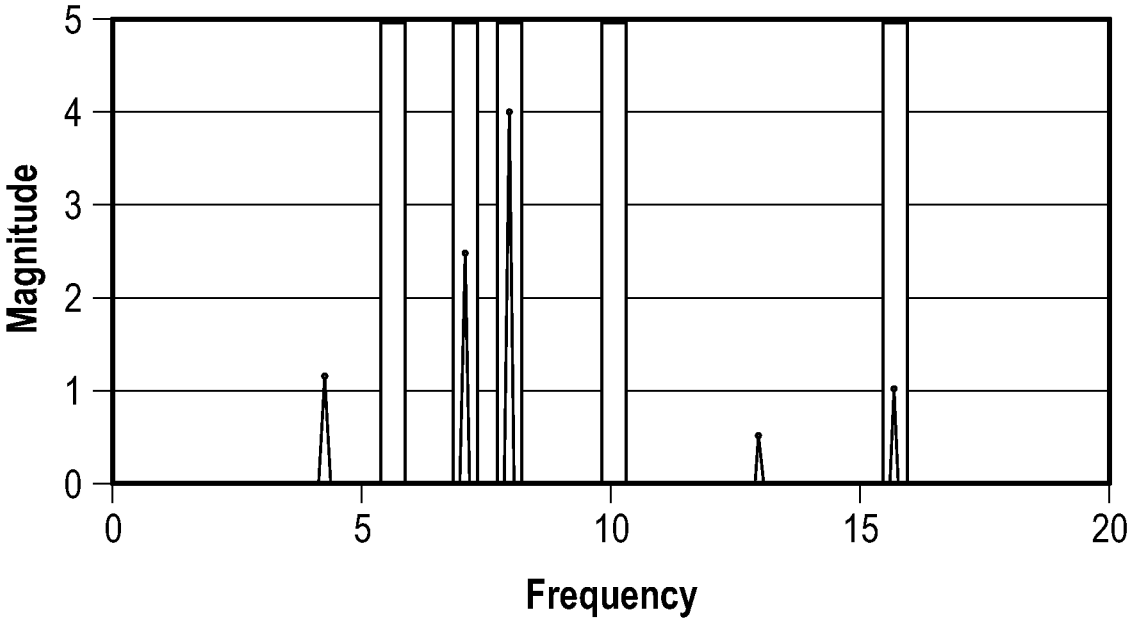
Figure 4D:
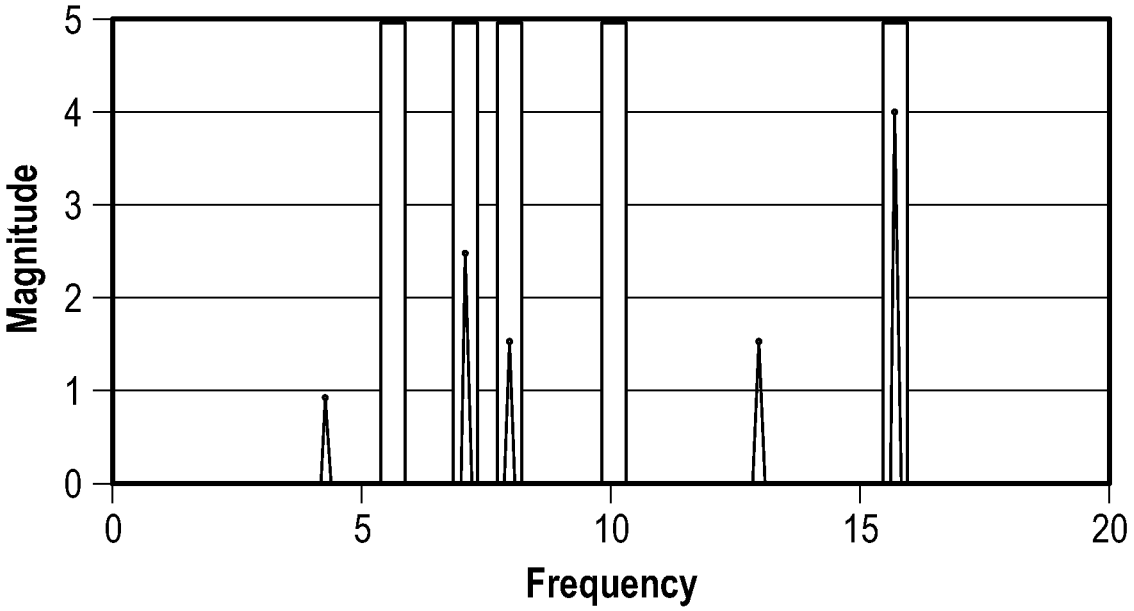

Another sensory evidence probability input is based on the probability of the resonance of vibrations in the frequency domain. Such an embodiment would require comparison of real-time mode-shapes with a spatial acceleration distribution based on IMU data, as shown in FIG. 3. FIG. 3 illustrates five graphs showing the first five frequency and different mode shapes. The mode shapes and frequencies change during the drilling process (e.g., change in contact points going through different drilling sections or due to change in weight-on-bit).

Results of frequency analysis at each IMU location then can be combined to construct spatial frequency patterns for IMUs A and B to determine dynamic status in the entire BHA, and a mathematical inference between spatial frequency patterns and physical dynamics can be constructed for given BHA. FIGS. 4A, 4B, 4C and 4D show four graphs which illustrate the time history signals measured at IMUs A and B, along with Fast Fourier transform (frequency) results at IMUs A and B.

Figure 5:
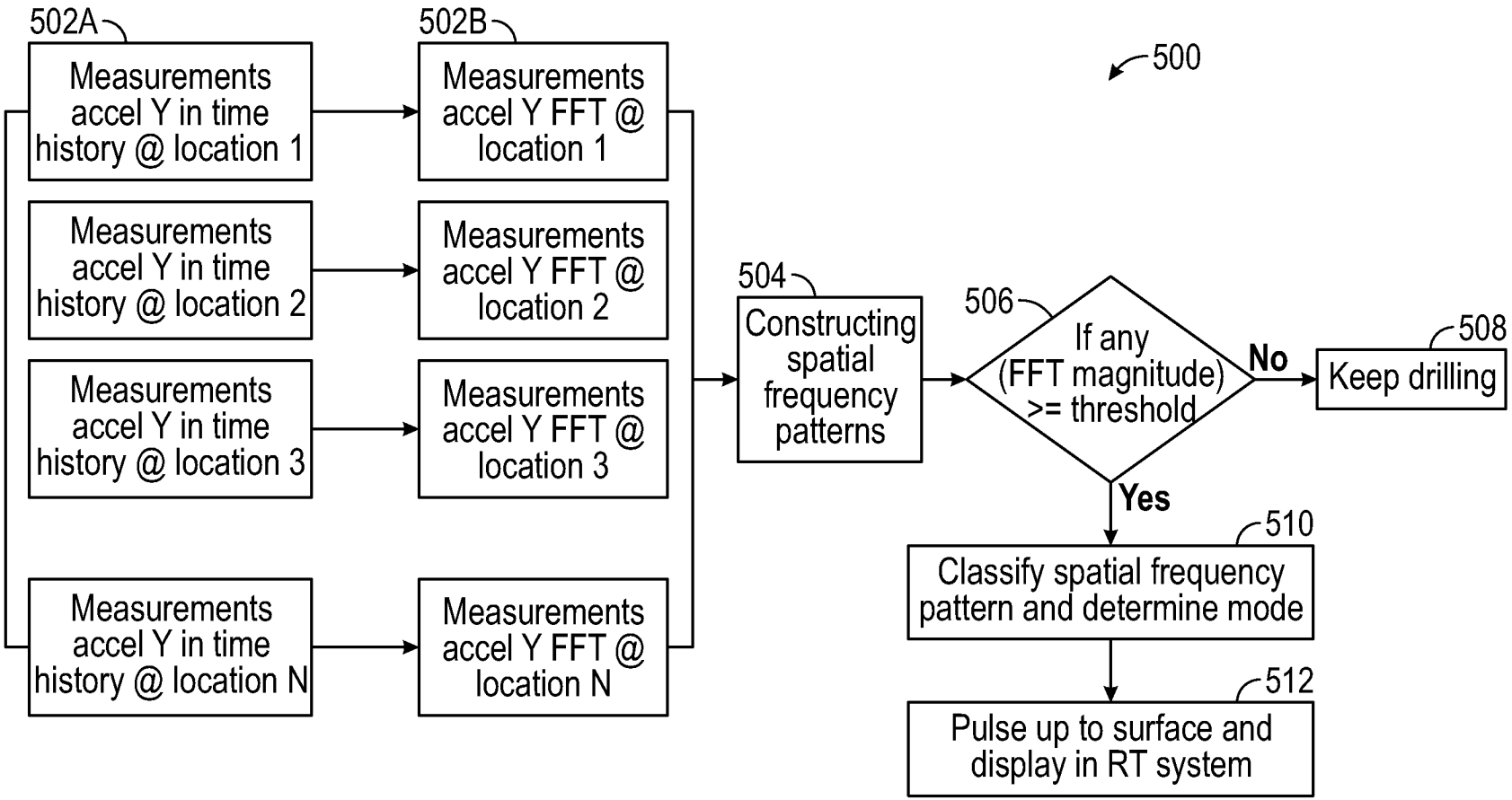
FIG. 5 is a block diagram for constructing inference performed by the processor, according to certain illustrative embodiments of the present disclosure.

With reference to FIG. 2, during drilling operations, distributed IMUs 26A and 26B collect time history data and performs fast Fourier transforms (FFT) of that data for predesignated period. In certain embodiments, a processor within BHA 20 aggregates multiple FFT results to construct spatial frequency patterns in real-time. The constructed spatial frequency patterns can be compressed as simple matrices or pre-designated codes, and can be transmitted to the surface real-time monitoring system through telemetry signals to determine lateral vibrations using the mathematical inference at the surface. In other embodiments, if the downhole BHA processor has enough computation power, spatial frequency patterns can be interpreted using the mathematical inference. Thereafter, the signals may be transmitted to the surface monitoring system with abstracted information, as illustrated in FIG. 5. FIG. 5 is a block diagram 500 for constructing inference performed by the processor. The block diagram shows time history measurements being obtained at various IMUs located along the BHA at block 502A, along with their associated FFTs at block 502B, which are then used to construct spatial frequency patterns at block 504. The processor then determines if the magnitude of any FFT exceeds a predetermined threshold at block 506. If NO, at block 508, the BHA continues drilling. If YES, at block 510, the spatial frequency pattern is classified and the mode is determined by, for example, use of a classification method to determine if the spatial frequency pattern matches one of the mode shapes or a combination thereof. Thereafter, in this example, at block 512, the classification is pulsed uphole to the surface as a telemetry signal where it may be displayed or otherwise communicated to surface processing systems and/or drilling personnel for mitigation actions if necessary. Moreover, the conditional probability for the frequency spectrum information with respect to different dynamic boundary conditions can be encoded before transmission uphole. These are probabilistically connected with the acceleration magnitude probability described previously, and can be treated as mutually exclusive to the conditional probability of the likelihood element.

Figure 6:
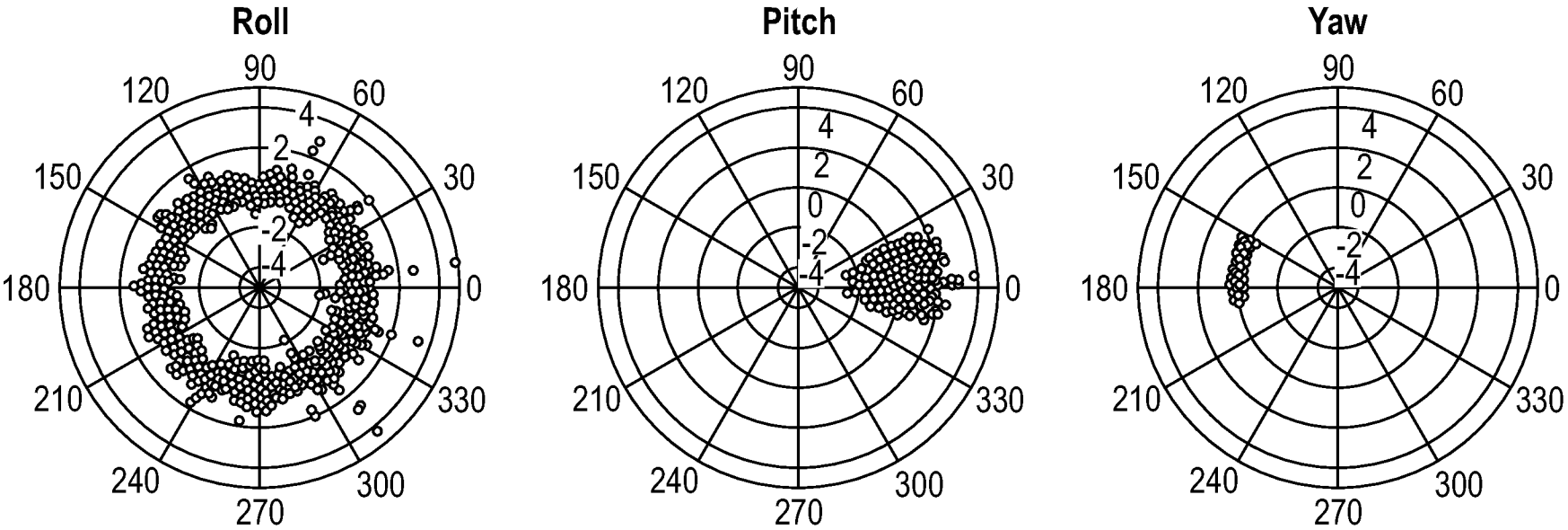
FIG. 6 illustrates the results of the motion model applied in illustrative embodiments of the present disclosure.

To further describe the principles of the present disclosure, the kinematic motion model used in embodiments of the present disclosure is based on local IMU sensory data such as multi-axes gyroscope. Accelerometers is another vector element of the evidence probability which may be utilized. Here, attitude estimation is applied to integrate IMU gyroscope measurements to estimate the location of the sensor body and correct the location with global gravity direction that is estimated from the rate regulated band pass filtered acceleration measurements. In certain embodiments, the high frequency acceleration data is filtered to remove uncorrelated Gaussian noise. The filtered accelerate data is then superimposed on each attitude estimate. This will give the true acceleration seen by the component at different radial orientations, as shown in FIG. 6. FIG. 6 illustrates the results of the motion model applied in illustrative embodiments of the present disclosure. The roll, pitch and yaw are plotted. The sensor location is indicated in the angular direction and the acceleration is plotted in the radial direction. Because of the absence of the absolute initial conditions of the global attitude and the nature of time-variant dynamics, the extracted motion with local vibrations can be expressed as the conditional probability of the likelihood function. Once the necessary probability components are obtained using the motion model, a joint probability model (which combines probabilities from each IMU) can be expressed as:

$$p(\text{Class}_k|x) = \frac{p(\text{Class}_k)}{p(x)} \prod_1^n p(x_i|\text{Class}_k). \quad \text{Eq. 2}$$

Here, the likelihood term is separated into individual conditional probability at a given vibration class compared to the original probability model, and it can be initially set based on either simulation results or heuristically determined values in general drilling operation guidance. For example, here is a list of likelihoods for vibration classification for forward whirl:

1. $p(x_{11}|\text{Class}_{lateral})$—Conditional probability of a threshold value at given operation conditions (e.g., RPM, WOB and dogleg, BHA geometry) given lateral vibration conditions.
2. $p(x_{12}|\text{Class}_{lateral})$—Conditional probability of Peak acceleration from IMU indicates high level of acceleration greater than simulated thresholds.
3. $p(x_1|\text{Class}_{lateral})=(x_{11},x_{12}|\text{Class}_{lateral})$—Joint probability of the conditional probability of simulated threshold and the conditional probability of measured data.
4. $p(x_1|\text{Class}_{lateral})$—Conditional probability of expected frequency range with given boundary conditions in the static analysis.
5. $p(x_{22}|\text{Class}_{lateral})$—Conditional probability of peak frequency from frequency analysis of acceleration data is within whirl frequency range.
6. $p(x_2|\text{Class}_{lateral})=(x_2,x_{22}|\text{Class}_{lateral})$—Joint probability of the conditional probability of the static analysis results and the conditional probability of the frequency analysis on measurements.
7. $p(x_3|\text{Class}_{lateral})$—conditional probability of partially correct motion model representing lateral vibration.

After tailoring the necessary probability functions, the processor determines the real-time calculations of the lateral vibration conditional probability value at given evidence probability to classify lateral vibrations in the BHA.

Figure 7:
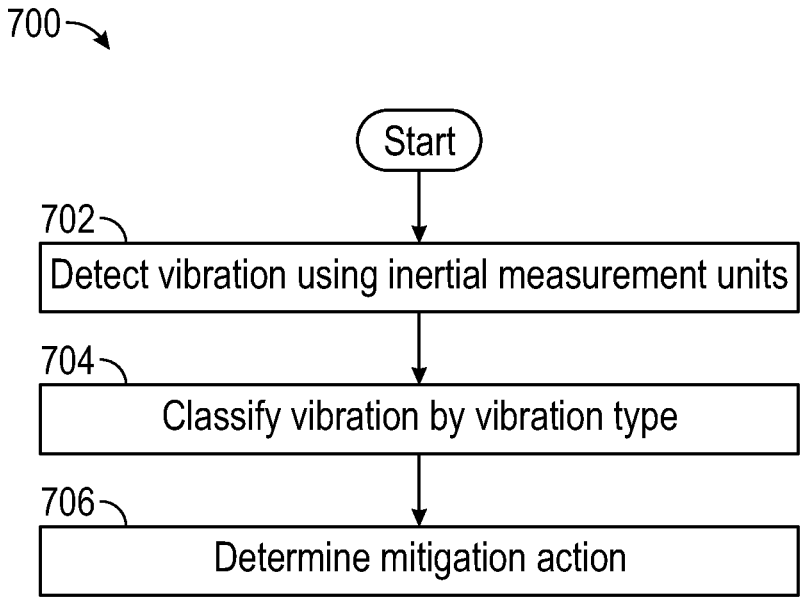
FIG. 7 is a flow chart of a method for mitigating drilling vibration in a hydrocarbon wellbore.

FIG. 7 is a flow chart of a method for mitigating drilling vibration in a hydrocarbon wellbore. At block 702 of method 700, one or more IMUs along the BHA are used to detection vibrations. AT block 704, processing circuitry coupled to the IMUs classifies the vibration by vibration type. The vibration type, for example, may be any of a number of lateral vibrations such as forward whirl, backward whirl or chaotic vibration. Forward whirl is BHA rotation in the same direction as whirl (movement of BHA in the wellbore); backward whirl is BHA rotation in the opposite direction as whirl (movement of BHA in the wellbore); chaotic vibration is when whirl direction keeps changing and doesn't align with BHA rotation.

At block 706, the processing circuitry then determines an appropriate mitigation action such as, for example, adjusting various drilling parameters. Such drilling parameters may be a direction or speed of the drilling assembly, pumping pressure, weight-on-bit, flow rate and RPM. The other controlling parameter is to stop drilling (pick up off-bottom) to dissipate the vibration energy and then go back to drilling. Thereafter, the drilling parameters corresponding to an optimal correction path are communicated to the steering system, whereby steering inputs are communicated to the steering mechanism of BHA to thereby orient it accordingly.

The foregoing methods and systems described herein are particularly useful in detecting and classifying lateral vibration to more accurately and precisely steer the drilling of wellbores. This disclosure further provides various other advantages such as providing a method to determine optimal locations for IMUs to effectively detect lateral vibration through use of distributed IMU placement guidance during BHA design based upon BHA static and dynamic analysis and simulations and off-set well data analysis. Heuristic or probabilistic approaches are applied to classifying vibration, based on multiple data/model sources. Downhole frequency analysis and motion modeling are used to process high speed vibration measurements. Further, to perform the described methods, the processors described herein may be trained using preprocessing BHA structural analysis and simulation results at the locations of preinstalled/existing distributed IMUs. The locations and magnitudes of lateral vibrations may be detected and classified in real-time by aggregating spatial frequency patterns from distributed IMUs. Lastly, the resulting data may be compressed for either downhole or surface processing to bypass bandwidth limitations of conventional mud pulse systems.

Embodiments described herein further relate to any one or more of the following paragraphs:

1. A computer-implemented method to mitigate drilling vibration in a subterranean wellbore, the method comprising: detecting vibration along a bottom hole assembly ("BHA") using one or more inertial measurement units ("IMUs"), the BHA being positioned along a drill string extending within a wellbore; classifying the vibration by determining a vibration type; and based upon the classified vibration, determining an action to mitigate the vibration along the BHA.

2. The computer-implemented method as defined in paragraph 1, wherein the vibration type is a lateral vibration.
3. The computer-implemented method as defined in paragraphs 1 or 2, wherein the vibration is classified using a probability model.
4. The computer-implemented method as defined in any of paragraphs 1-3, wherein the probability model is applied to perform real-time calculations of lateral vibrations in the BHA.
5. The computer-implemented method as defined in in any of paragraphs 1-4, wherein the probability model combines vibration data obtained from two or more IMUs.
6. The computer-implemented method as defined in in any of paragraphs 1-5, wherein the vibration is classified downhole using processing circuitry located along the BHA; and a signal reflecting the classified vibration is transmitted uphole to a surface.
7. The computer-implemented method as defined in in any of paragraphs 1-6, further comprising adjusting, in response to the determined mitigation action, a drilling parameter of the BHA to mitigate the vibration.
8. A system to mitigate drilling vibration in a subterranean wellbore, the system comprising a bottom hole assembly ("BHA") having one or more inertial measurement units ("IMUs") which detect vibration along the BHA, the BHA being positioned along a drill string extending within a wellbore; and processing circuitry communicably coupled to the IMUs to classify the vibration by determining a vibration type and, based upon the classified vibration, determine an action to mitigate the vibration along the BHA.
9. The system as defined in paragraph 8, wherein the vibration type is a lateral vibration.
10. The system as defined in paragraphs 8 or 9, wherein the vibration is classified using a probability model.
11. The system as defined in in any of paragraphs 8-10, wherein the probability model is applied to perform real-time calculations of lateral vibrations in the BHA.
12. The system as defined in in any of paragraphs 8-11, wherein the probability model combines vibration data obtained from two or more IMUs.
13. The system as defined in in any of paragraphs 8-12 the vibration is classified downhole using the processing circuitry located along the BHA; and a signal reflecting the classified vibration is transmitted uphole to a surface.

Furthermore, the illustrative methodologies described herein may be implemented by a system comprising processing circuitry or a non-transitory computer program product comprising instructions which, when executed by at least one processor, causes the processor to perform any of the methodology described herein.

Although various embodiments and methodologies have been shown and described, the disclosure is not limited to such embodiments and methodologies and will be understood to include all modifications and variations as would be apparent to one skilled in the art. Therefore, it should be understood that the disclosure is not intended to be limited to the particular forms disclosed. Rather, the intention is to cover all modifications, equivalents and alternatives falling within the spirit and scope of the disclosure as defined by the appended claims.

What is claimed is:

1. A computer-implemented method to mitigate drilling vibration in a subterranean wellbore, the method comprising:

detecting vibration along a bottom hole assembly ("BHA") using one or more inertial measurement units ("IMUs"), the BHA being positioned along a drill string extending within a wellbore;

classifying the vibration by determining a type of lateral vibration using a probability model;

based upon the determined type of lateral vibration, determining an action to mitigate the lateral vibration along the BHA; and performing the action by adjusting a drilling parameter; wherein the drilling parameter is selected from the group consisting of a direction of a drilling assembly, a speed of the drilling assembly, a pumping pressure, a weight-on-bit, a flow rate, and an RPM.

2. The computer-implemented method as defined in claim 1, wherein the type of lateral vibration is either forward whirl, backward whirl, or chaotic vibration.

3. The computer-implemented method as defined in claim 1, wherein the probability model is applied to perform real-time calculations of lateral vibrations in the BHA.

4. The computer-implemented method as defined in claim 1, wherein the probability model combines vibration data obtained from two or more IMUs.

5. The computer-implemented method as defined in claim 1, wherein:

the vibration is classified downhole using processing circuitry located along the BHA; and a signal reflecting the classified vibration is transmitted uphole to a surface.

6. A non-transitory computer program product including instructions which, when executed by at least one processor, causes the processor to a method comprising:

detecting vibration along a bottom hole assembly ("BHA") using one or more inertial measurement units ("IMUs"), the BHA being positioned along a drill string extending within a wellbore;

classifying the vibration by determining a type of lateral vibration using a probability model;

based upon the determined type of lateral vibration, determining an action to mitigate the lateral vibration along the BHA; and performing the action by adjusting a drilling parameter; wherein the drilling parameter is selected from the group consisting of a direction of a drilling assembly, a speed of the drilling assembly, a pumping pressure, a weight-on-bit, a flow rate, and an RPM.

7. The computer program product as defined in claim 6, wherein the type of lateral vibration is either forward whirl, backward whirl, or chaotic vibration.

8. The computer program product as defined in claim 6, wherein the probability model is applied to perform real-time calculations of lateral vibrations in the BHA.

9. The computer program product as defined in claim 6, wherein the probability model combines vibration data obtained from two or more IMUs.

10. The computer program product as defined in claim 6, wherein:

the vibration is classified downhole using processing circuitry located along the BHA; and a signal reflecting the classified vibration is transmitted uphole to a surface.

11. A system to mitigate drilling vibration in a subterranean wellbore, the system comprising:

a bottom hole assembly ("BHA") having one or more inertial measurement units ("IMUs") which detect vibration along the BHA, the BHA being positioned along a drill string extending within a wellbore; and processing circuitry communicably coupled to the IMUs and configured to:

classify the vibration by determining a type of lateral vibration using a probability model;

based upon the determined type of lateral vibration, determine an action to mitigate the lateral vibration along the BHA; and perform the action by adjusting a drilling parameter; wherein the drilling parameter is selected from the group consisting of a direction of a drilling assembly, a speed of the drilling assembly, a pumping pressure, a weight-on-bit, a flow rate, and an RPM.

12. The system as defined in claim 11, wherein the vibration type of lateral vibration is either forward whirl, backward whirl, or chaotic vibration.

13. The system as defined in claim 11, wherein the probability model is applied to perform real-time calculations of lateral vibrations in the BHA.

14. The system as defined in claim 11, wherein the probability model combines vibration data obtained from two or more IMUs.

15. The system as defined in claim 11:

the vibration is classified downhole using the processing circuitry located along the BHA; and a signal reflecting the classified vibration is transmitted uphole to a surface.

* * * * *